US005364458A

United States Patent [19]

Burnett et al.

[11] Patent Number: 5,364,458

[45] Date of Patent: Nov. 15, 1994

[54] ADJUSTABLE AIR FILTERING DEVICE

[75] Inventors: Gilbert W. Burnett, Rockwall; Robert B. Holland, Rowlett, both of Tex.

[73] Assignee: Dust Free, Inc., Royse City, Tex.

[21] Appl. No.: 33,041

[22] Filed: Mar. 18, 1993

[51] Int. Cl.[5] ..... B03C 3/14

[52] U.S. Cl. ..... 96/55; 55/496; 96/68; 96/80

[58] Field of Search ..... 55/2, 6, 103, 496, 130, 55/131, 124, 126, 139; 95/63, 69, 70; 96/17, 55, 57–59, 66, 65, 68, 80

[56] References Cited

U.S. PATENT DOCUMENTS

| | | | |
|---|---|---|---|
| 1,122,437 | 12/1914 | Sweeney | 160/373 |
| 2,175,903 | 10/1939 | Lichtman | 55/491 |
| 2,565,698 | 8/1951 | Patterson | 52/645 |
| 2,624,405 | 1/1953 | Lynch | 160/353 |
| 2,981,367 | 4/1961 | Sprouse | 55/491 |
| 3,280,984 | 10/1966 | Sexton et al. | 210/485 |
| 3,675,402 | 7/1972 | Weed | 55/496 |
| 3,735,560 | 5/1973 | Wellman | 55/155 X |
| 3,763,633 | 10/1973 | Soltis | 55/131 X |
| 4,549,887 | 10/1985 | Joannou | 55/131 |
| 5,059,218 | 10/1991 | Pick | 55/131 |
| 5,087,276 | 2/1992 | Snyder | 55/496 |

FOREIGN PATENT DOCUMENTS

| | | | |
|---|---|---|---|
| 2211110 | 6/1989 | United Kingdom | 55/496 |

OTHER PUBLICATIONS

"The Web" and 'The Air Medic' Frame Assembly Instruction Brochure, Rolox, Kansas City, Mo., 64101, No date, pp. 1–3.

*Primary Examiner*—Richard L. Chiesa
*Attorney, Agent, or Firm*—Vinson & Elkins

[57] ABSTRACT

An adjustable filter uses an eight member frame construction to provide a wide range of filter sizes. A panel for encasing one or more layers of filtering materials within the frame is formed from a grid having a border which unevenly encompasses the crossbars of the panel in order to allow various sizes of panels to be formed without producing exposed barbs and without increasing the air resistance of the filter. An embodiment using an electric field is disclosed to enhance the filtering properties of the filter.

8 Claims, 4 Drawing Sheets

ADJUSTABLE AIR FILTERING DEVICE

TECHNICAL FIELD OF THE INVENTION

This invention is related in general to filtration systems, and more particularly to an adjustable air filtering device.

BACKGROUND OF THE INVENTION

The importance of proper air filtration equipment has received increased recognition over the last few years. Increasingly, consumers are opting for air filters which have a greater efficiency in removing undesirable matter from the air. The desire for better air filters extends to both the home and workplace.

One problem with the purchase of a proper air filter is the wide range of sizes which must be supported for various residential and commercial air conditioning and heating equipment. While a number of standard sizes exist, the number of different sizes which must be carried by a supplier is great. Unusual sizes, therefore, may be hard to find. Further, a consumer may not know the appropriate filter size when he or she is in a position to make a purchase, such as when the consumer is at a hardware store.

Accordingly, a number of filter kits have been developed that let the consumer (who may be a homeowner or a contractor, for example) assemble an air filter according to his or her needs, without prior knowledge of the correct size. This allows the supplier or contractor to carry a single kit which covers a wide range of filter sizes.

Present day adjustable filter kits have significant drawbacks, particularly in ease of assembly. In many cases the consumer must perform a significant amount of work in measuring and cutting the parts of the kit. Further, many present day kits are limited in size range, and therefore do not cover all popular air filter sizes. Available adjustable filters also provide inadequate sealing with the filter holding device in which they are mounted, thereby allowing significant amounts of air to pass by the filter.

One example of a present day adjustable air filtration kit 10 is shown in FIG. 1*a*. This kit comprises filtering material 12 (shown in the cutaway view) which is held between mesh 14 in frame 16. Frame 16 is comprised of four corner pieces, denoted generally by reference numeral 18, including two male (outer) corner pieces 18*a* and two female (inner) corner pieces 18*b* which are slideably engaged to effect a frame of the proper size.

This type of filter kit has three distinct problems. First, the design of the filter uses male corner pieces, which are dimensioned to slide within the female pieces. Thus, a relatively large portion of the frame will not seal properly with the filter holding device, which is expecting a frame of uniform thickness. Consequently, air is allowed to bypass the filter in these areas.

Second, a fairly fine mesh is generally used to simplify cutting of the mesh material to a desired size. A fine mesh, however, significantly increases the air flow resistance of the air filter. The use of a wider mesh is inconvenient because cutting the mesh will often result in exposed barbs 22 (see FIG. 1*b*) which make the final assembly more difficult.

Third, although the manufacturer of the kit may provide a template, such as described in connection with U.S. Pat. No. 5,087,276 to Snyder, actual assembly of the frame and cutting of the mesh and filter medium is typically cumbersome.

One method of improving the efficiency of an air filter is to apply a voltage to the filter to increase the filtering efficiency of the filtering elements within the filter. This method is discussed in U.S. Pat. No. 4,549,887. Filters employing an electric field have two distinct problems: (1) The bulk of the power supply greatly diminishes the filtering area of the filter and (2) the application of a high voltage from an external power source is cumbersome and potentially dangerous.

Therefore, a need has arisen in the industry for an adjustable air filter kit which is capable of accommodating a wide range of filter sizes, and which is easily sized, and further, a filter which can accommodate an electric field without significantly affecting filter size or requiring a high voltage external power supply.

SUMMARY OF THE INVENTION

An air filtration system is provided which uses four corner members, each having two sides forming a 90° angle and four side members. Each side member may connect to two sides of respective corner members to form a frame of desired dimensions. A filtering media is disposed within the frame. The arrangement of four corner members and four side members provides the maximum flexibility in forming a frame of desired dimensions while minimizing air leaks.

In a second aspect of the present invention, a grid is provided for holding the filtering media within the adjustable frame. The grid has first cross members oriented in a first direction and spaced at even intervals except for one cross member disposed at the end of the sequence cross members which is spaced by a nonuniform distance. Similarly, the grid has second cross members disposed substantially orthogonal to the first cross members and spaced from one another by a uniform interval, except a last of the second cross members which is spaced from the other cross members at a nonuniform interval. This arrangement of cross members provides for the cutting along cross members to make filters of a standard size such as 16"×20", 20"×25" and so on.

In a second embodiment of the present invention, a power source is coupled to the air filter to provide a desired potential between two screens separated by a intermediate filter. In the preferred embodiment, the screens comprise a mesh of polypropylene and metal fibers to promote the electric field. The circuitry for generating the potential is fabricated as part of the outer grid to provide easy fabrication for an adjustable size filter.

BRIEF DESCRIPTION OF THE DRAWINGS

For a more complete understanding of the present invention, and the advantages thereof, reference is now made to the following descriptions taken in conjunction with the accompanying drawings, in which:

FIG. 6*b* illustrates a block diagram of the power supply of the filter of FIG. 6*a.

DETAILED DESCRIPTION OF THE PREFERRED EMBODIMENTS

The preferred embodiment of the present invention is best understood by referring to FIGS. 2–7 of the drawings, like numerals being used for like and corresponding parts of the various drawings.

Figure 2:
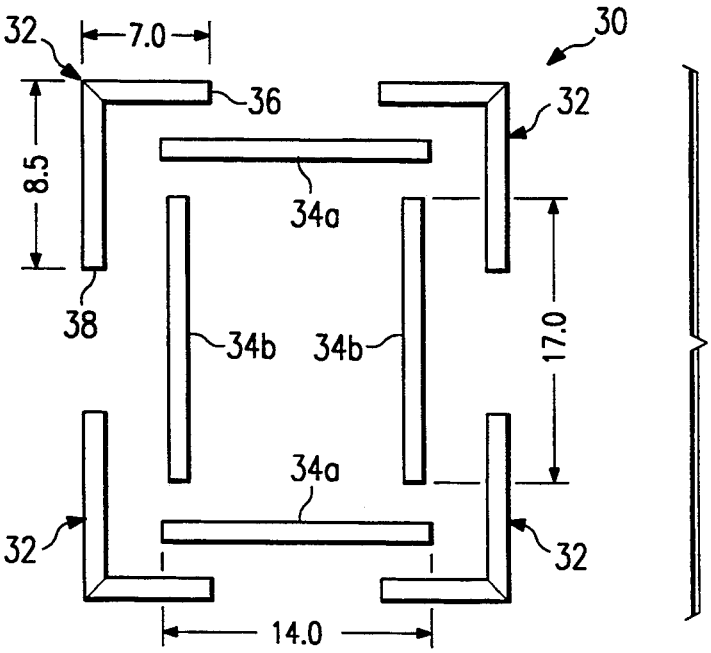
FIG. 2 illustrates a top view of the frame members of the adjustable air filter of the present invention.

FIG. 2 shows an exploded view of the frame members for the air filter along with exemplary dimensions for the frame members in the preferred embodiment. Frame 30 comprises corner members 32 and side members, denoted generally by reference number 34. Side members 34 include two side members 34*a* disposed on opposite sides of the frame 30 and two side members 34*b,* also disposed on opposite sides of the frame 30. Corner members 32 each have a first portion 36 which is seven inches in length and a second portion 38 which is 8.5 inches in length. The first and second portions meet at a right angle to form a corner. Side members 34 are straight, with side members 34*a* being fourteen inches in length and side members 34*b* being seventeen inches in length.

Figure 3A:
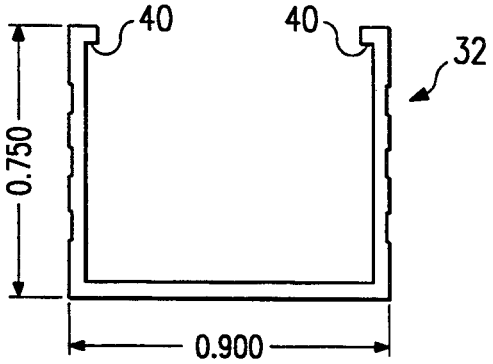
FIGS. 3*a–b* illustrates cross-sectional side views of the frame members.
Figure 3B:
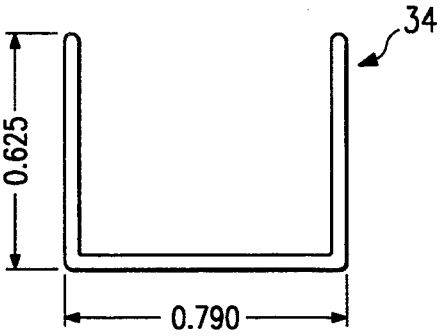

In the preferred embodiment, the side members 34 are slideably engageable within the corner members 32. FIGS. 3*a* and 3*b* illustrate cross-sectional side views of a corner member 32 and a side member 34, respectively. The corner member 32 is formed with a lip 40 to hold a side member 34 within its interior. Preferred dimensions for the members are shown in FIGS. 3*a–b.*

The corner members 32 and side members 34 may be constructed of either metal or plastic. In the preferred embodiment, the corner and side members are fabricated from plastic and the corner members 32 are notched and folded to create the ninety degree corner.

Figure 3C:
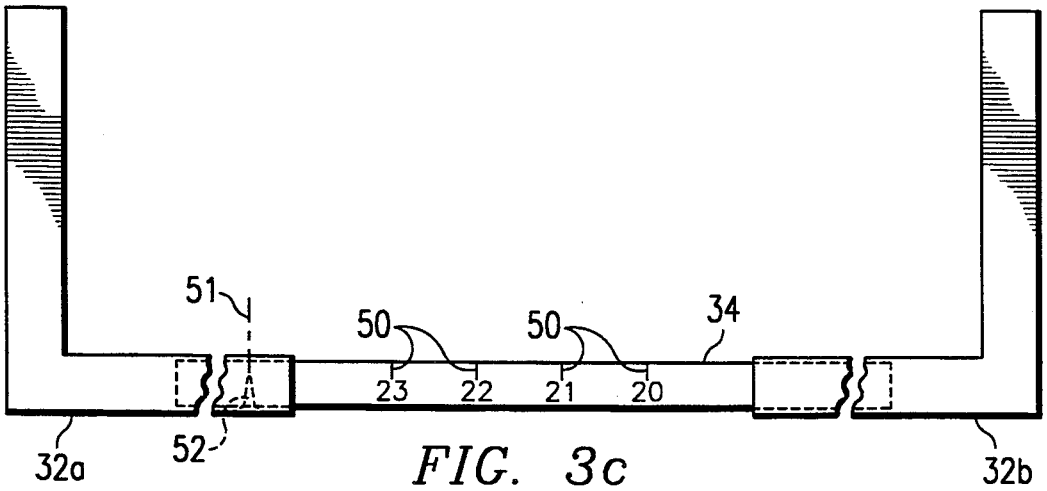
FIG. 3*c* illustrates an adjustable filter frame using scored frame members to facilitate construction.

As will be discussed in greater detail in connection with FIG. 5, the frame 30 is constructed by inserting the side members 34 within the channels of the corner members 32, adjusting the frame 30 to desired dimensions and affixing the mated members together using, for example, a screw through both members 32 and 34. FIG. 3*c* illustrates an aspect of the invention which facilitates the sizing of the frame 30. In this embodiment, the side members 34 are scored with dimension marks, shown on FIG. 3*c* at 50. One end of each side member 34 is affixed at point 51 of a portion of one of the corner members 32*a* at the time of manufacture as shown by screw 52. The user then slides the opposite corner member 32*b* along the side member 34 until the end of the corner member 32*b* is in line with the score corresponding to the desired dimension. The frame 30 is then secured at that dimension by attaching corner member 32*b* to the side member 34 using a screw. For ease of construction, corner member 32*b* has a predrilled hole.

While the embodiment of FIG. 3*c* facilitates the measurement of the frame 30, it requires that one side of the side member 34 be fixed to a corner member 32. In some instances, a desired side dimension is outside the range that can be accomplished with side member 34 affixed to the corner member 32*a* at point 51. In this case, screw 52 may be removed and the side member 34 may be adjusted within corner member 32*a* to a location which will provide the desired dimension.

As can be seen, the frame 30 of FIGS. 2–3 can be adjusted to a wide range of dimensions. Using the dimensions shown in FIG. 2, the frame 30 can accommodate sizes as large as approximately 30 inches by 24 inches or, by exchanging side members 34*a* and 34*b* to transfer three inches of span from the long side to the short side, a 27 inch×27 inch frame may be constructed. A frame as small as 14 inches by 18 inches can be made using these dimensions. This range of sizes covers almost all conventional filter sizes.

Figure 1A:
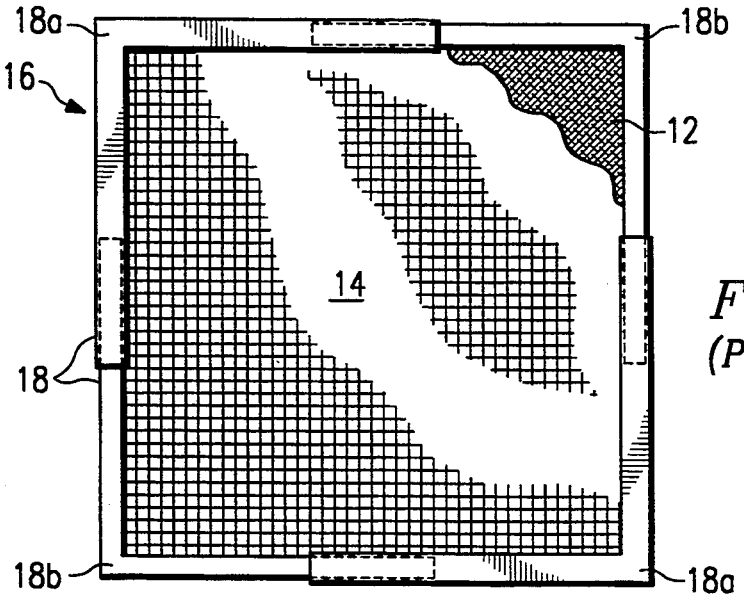
FIG. 1a (PRIOR ART)
FIGS. 1*a–b* illustrate a prior art adjustable air filter.
Figure 1B:
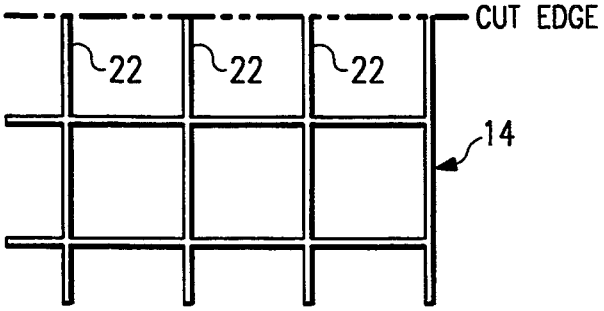
FIG. 1b (PRIOR ART)

When placed in an appropriate filter holder, adjustable filters will have a small gap between the filter holder and the male members of the frame, which are of lesser thickness in order to slide within the female members. In operation, some air will flow through this gap, and hence be unfiltered. The eight piece design shown herein reduces the gap in comparison to the prior art adjustable filter and therefor provides a more effective seal with the seal edge of a filter holder than do filters based on the design of FIG. 1.

Figure 4:
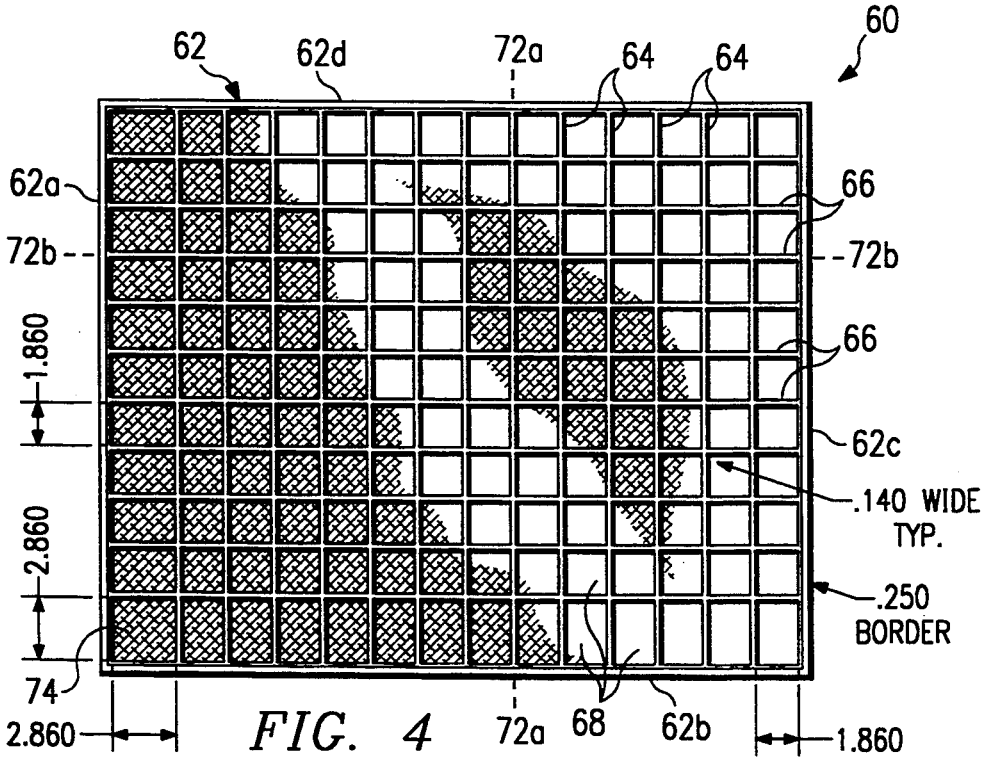
FIG. 4 illustrates a grid for use in the adjustable air filter having multiple grid spacing.

FIG. 4 illustrates a top view of a panel 60 which is disposed within the frame 30. In construction of the filter, two such panels are used to hold the filtering elements within the frame 30. The panel 60 is preferably formed of injection-molded plastic. The border 62 encompasses vertical crossbars 64 and horizontal crossbars 66. The crossbars 64 are spaced from one another by a uniform distance. In the illustrated embodiment, the crossbars are spaced at two inches (including the width of one crossbar). However, two adjoining edges of the border 62 (shown as 62*a* and 62*b*) are spaced from the closest crossbar by three inches (including the width of one crossbar), while the other two edges 62*c* and 62*d* are spaced from the closest crossbar by two inches.

The construction of the panel 60 in this manner provides a significant advantage in construction of the filter. The holes 68 in the panel are approximately 2 inches square. However, the panel can be sized to any desired full inch dimension with the ultimate sides of the panel cut at a crossbar, such that exposed barbs are not present. If a filter has height and width dimensions which are both odd integer numbers, for example 17″×17″, the panel can be measured from corner 70*a* and cut along lines 72*a* and 72*b*. If a filter has both odd and even integer dimensions, for example 17″×16″, the panel can be measured from corner 70*b* and cut along lines 72*b* and 72*c*. If a filter has two even integer dimensions, the panel can be measured from corner 72*c*.

In the prior art, using a grid of crossbars with uniform space from the border, in order to allow the panel to be cut at the crossbars at one inch integer dimensions, the grid would necessarily have holes which were one inch by one inch, which would double the number of crossbars in the panel. This greatly increases the air resistance of the filter. It should be noted, however, that the panel shown in FIG. 4 could have other dimensions while providing the advantage of increasing the number of dimensions which can be formed along a crossbar without increasing the number of crossbars. Further, the offsets between the border edges and the crossbars 64 could be offset to accommodate nominal size constraints (i.e., for a 17″×17″ filter size, the panel size would be slightly less than 17″×17″ to provide for the frame wall thickness and the undersizing of the frame).

A second important aspect of the filter of the preferred embodiment is that an electrostatic filter 74 is bonded to the panel such that cutting the panel to size also cuts the electrostatic material layer to size. The electrostatic filter layer is commonly formed of a weave of polypropylene fibers. The material can be bonded to the panel at the time of manufacture by placing the material in the injection mold die prior to injecting the plastic material. The panel material and electrostatic filter layer may be cut using heavy-duty scissors.

Figure 5:
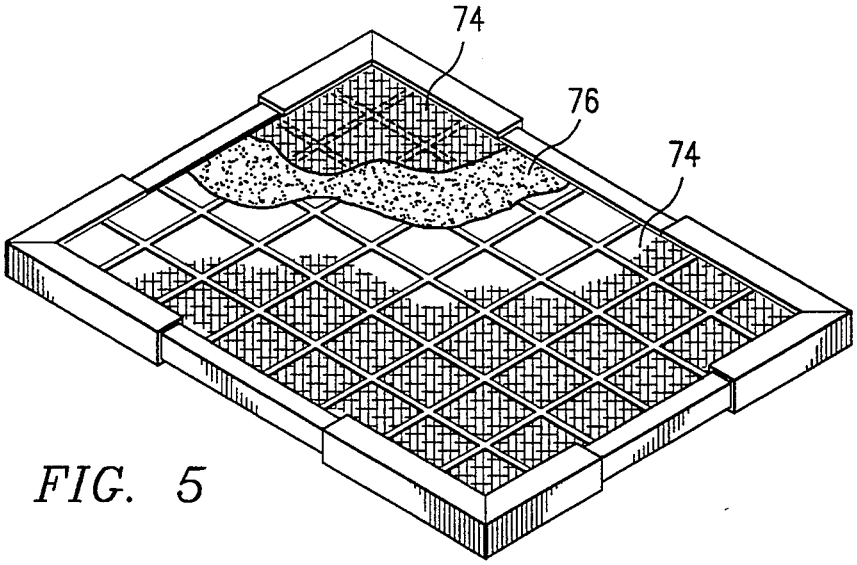
FIG. 5 illustrates a perspective view of a constructed air filter.

FIG. 5 shows a completed filter in cutaway view. The frame members 32 and 34 are affixed to one another by screws 52. A layer of foam 76 is sandwiched between panels 60 having the electrostatic material 74 adhered thereto. If desired, another layer of electrostatic material may be placed on either side of the foam layer 76. In the preferred embodiment, the second electrostatic material layer is charged opposite to that of the electrostatic material attached to the panel 60.

FIG. 6 illustrates a second embodiment of the invention using a charged filter to enhance its filtering efficiency. While this embodiment of the filter is described in conjunction with the adjustable filter described in connection with the adjustable frame disclosed in FIGS. 2–5, aspects of the invention are equally suited to filters of fixed-frame construction.

The charged filter 100 provides an AC inlet 102 on the frame 104 for connection to a household (or commercial) power supply via cord 106. In the illustrated embodiment, the construction of the frame 104 is the same as previously described in connection with FIGS. 2, 3*a* and 3*b*.

The charged filter 100 differs from the filter shown in FIGS. 2–5 in that an electric field is applied to the front panel 108 and rear panel 110 to form a potential between the two panels (or, in an alternative embodiment, between the outer panels and an inner panel situated between the outer panels). A collecting filter 112 is disposed between the front panel 108 and rear panel 110. The collecting filter 112 is typically a reticulated foam or fiberglass pad.

Figure 6B:
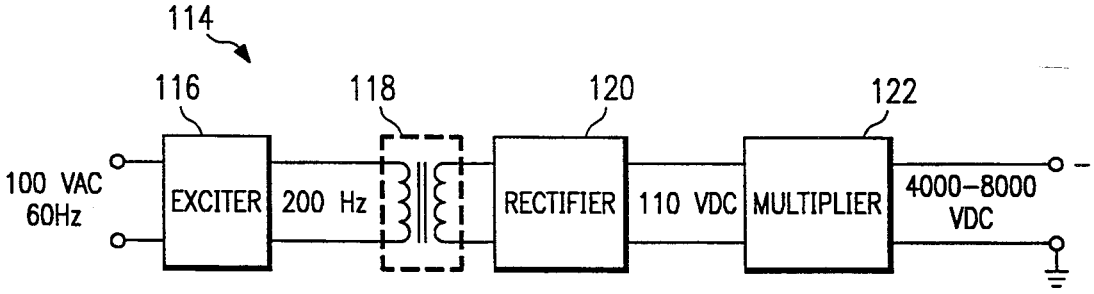
Figure 6A:
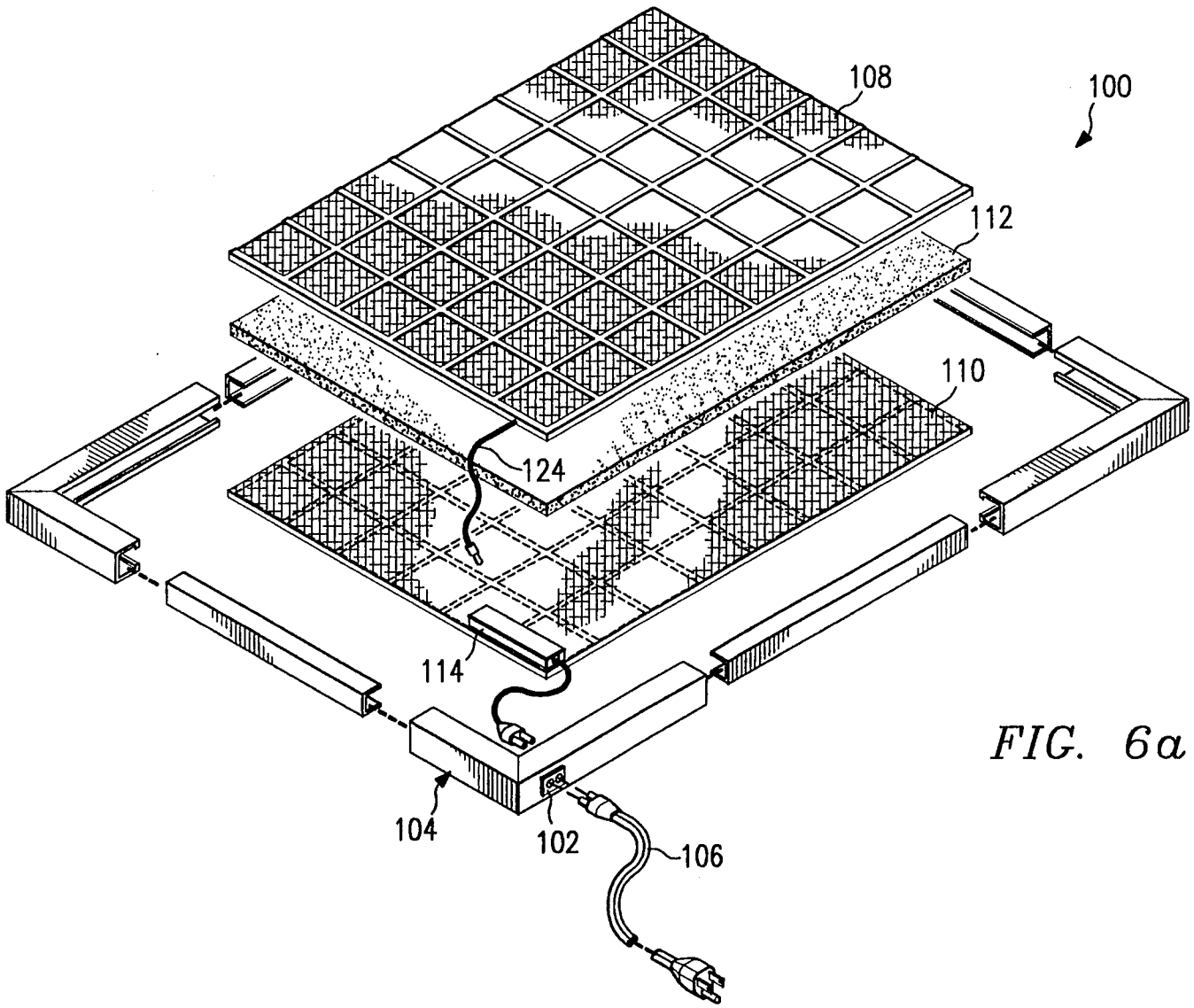
FIG. 6*a* illustrates a exploded view of a second embodiment of the present invention using a charged media.

A power supply 114 is mounted on either the front panel 108 or rear panel 110 (in the illustrated embodiment of FIG. 6*a*, the power supply 114 is mounted on rear panel 110). The power supply connects to inlet 102 to receive the 110 volt AC input and converts the input to a DC potential in the range of 4,000–8,000 volts DC. The front panel 108 is coupled to the negative voltage outlet terminal of power supply 114 and the rear panel 110 is coupled to ground. The power supply 114 can be manufactured of integrated components and mounted to the edge of the panel 110, where the power supply is covered by the edge of the frame.

FIG. 6*b* illustrates a block diagram of the power supply 114. In the preferred embodiment, the 110 volt AC, 60 Hz., power supply is coupled to an exciter 116 which increases the frequency of the signal to 200 Hz and creates spikes on the waveform. The 200 Hz signal is coupled to a transformer 118 and rectifier 120 which produces a 110 volt DC output. The 110 volt DC output is coupled to a voltage multiplier 122 which outputs a 4,000–8,000 volt DC output. While the voltage output of the power supply 114 is high, the current output should be low to prevent hazards to humans and to prevent high temperatures caused by conduction between the panels. Further, in this embodiment, the frame should be plastic or an insulated metal to prevent conduction between panels. Also, the power supply is monitored by a current sensing device (not shown) which disables the power supply in the event that a predetermined level of current is conducted through the filter.

In order to provide a good electric field, it is desirable to introduce an effective conductor to the panels. One method would be to attach a wire screen to the panel (or to provide a wire screen on either side of the foam layer 112). The wire screen is then connected to the power supply 114 through connector 124 (shown for front panel 108 only). In the preferred embodiment, however, the potential is applied to the panels by introducing metal wire strands to the polypropylene weave. This aspect of the invention is shown in greater detail in connection with FIG. 7.

Figure 7:
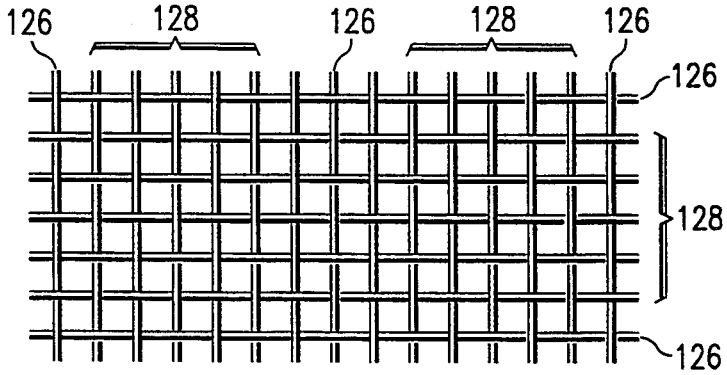
* and FIG. 7 illustrates a detailed view of the mixed weave of wire and electrostatic mesh.

In FIG. 7, a simplified weave is shown with approximately every sixth strand being a metal strand 126. The remaining stands 128 are polypropylene or another electrostatic material. The proportion of metal strands to polypropylene strands may be adjusted as desired. In the preferred embodiment, the wire strands comprise aluminum, although other conductors may be equally as effective. Alternatively, an entirely conductive wire mesh, comprising aluminum or another conductive wires, may be used.

The electric field promotes the filtering efficiency of the filter in two ways. First it enhances the electrostatic field created as air flows through the electrostatic material layers. Second, it disrupts the flow of particulate matter through the various layers of filter materials. As air flows through the filter, the entrained particulate matter is moving in a generally linear path. Electrostatic material layers attract charged particulate matter, and hence filter matter which is drawn to or impinges on the fibers. The foam filters disrupt the linear path by generally providing circuitous routes through which the air must travel. A foam filter will also develop an electrostatic charge.

The electric field enhances the filtering capabilities of the various filtering layers by driving the particulate matter sideways, and thus increasing the opportunity for a particle to impinge, or be attracted to, the filtering material. In this regard, there may be some benefit in pulsing the electric field presented to the panels to further disrupt the path of the particulate matter.

Although the preferred embodiment has been described in detail, it should be noted that various changes, substitutions and alterations could be made herein without departing from the spirit and scope of the invention as defined by the appended claims.

What is claimed is:

1. An adjustable air filtration system comprising:

four corner frame members, each corner member having two side portions forming a ninety degree angle; and four side frame members, each side member connectable to two side portions of respective corner frame members;

said frame members connectable to one another at a plurality of points to form a frame of desired dimensions;

dimension markings disposed on at least one of the frame members for alignment with another of said frame members to aid a user in connecting the frame members at a proper point to form the frame at the desired dimensions;

a filtering medium for disposal within the frame; and at least one panel for holding the filtering medium within the frame, said panel including a grid comprising:

a plurality of equally spaced apart first crossbars aligned perpendicular to a plurality of equally spaced apart second crossbars; and a rectangular border encompassing said first and second crossbars, said border having a first edge parallel to the first crossbars and spaced from the nearest first crossbar by a first distance and a second edge parallel to the second crossbars and spaced from the nearest second crossbar by a second distance, said first distance is approximately 50% greater than said second distance.

2. The air filtration system of claim 1 wherein said panel comprises a grid for cutting to a desired size.

3. The air filtration system of claim 1 and further comprising a power source coupled to said panel for providing a potential to the filtering medium.

4. The air filtration system of claim 3 wherein said filtering medium includes at least one electrostatic filter electrically coupled to said power source.

5. The air filtration system of claim 4 wherein said filtering medium is comprised entirely of a conductive material.

6. The air filtration system of claim 4 wherein said electrostatic filter includes one or more strands of conductive material.

7. The air filtration system of claim 6 wherein said conductive material comprises aluminum.

8. The air filtration system of claim 6 wherein said electrostatic filter is bonded to said panel prior to cutting, such that the panel and filter may be simultaneously sized.

* * * * *